US010813466B2

(12) United States Patent
Jin

(10) Patent No.: US 10,813,466 B2
(45) Date of Patent: Oct. 27, 2020

(54) FOLDABLE BED FRAME WITH ASYMMETRICALLY ARRANGED SUPPORTING LEGS

(71) Applicant: Xiamen Innovation Metal Products Co., Ltd., Xiamen (CN)

(72) Inventor: Ju Young Jin, Xiamen (CN)

(73) Assignee: Xiamen Innovation Metal Products Co., Ltd., Xiamen (CN)

( * ) Notice: Subject to any disclaimer, the term of this patent is extended or adjusted under 35 U.S.C. 154(b) by 222 days.

(21) Appl. No.: 15/809,161

(22) Filed: Nov. 10, 2017

(65) Prior Publication Data

US 2018/0125255 A1 May 10, 2018

(30) Foreign Application Priority Data

Nov. 10, 2016 (CN) ..... 2016 2 1212778 U

(51) Int. Cl.
*A47C 19/12* (2006.01)
*A47C 19/04* (2006.01)
*A47C 19/02* (2006.01)

(52) U.S. Cl.
CPC ..... *A47C 19/12* (2013.01); *A47C 19/024* (2013.01); *A47C 19/04* (2013.01); *A47C 19/122* (2013.01)

(58) Field of Classification Search
CPC ..... A47C 19/12; A47C 19/024; A47C 19/122; A47C 19/04; A47C 19/005; A47C 19/14; A47C 19/126; A47C 19/124; A47C 19/022; A47C 19/021; A47C 19/025; F16B 12/56
See application file for complete search history.

(56) References Cited

U.S. PATENT DOCUMENTS

| | | | |
|---|---|---|---|
| 190,338 | A | 5/1877 | Hall |
| 261,770 | A | 7/1882 | Segar |
| 478,761 | A | 7/1892 | Rodecap |
| 605,126 | A | 6/1898 | Odell |
| 767,680 | A | 8/1904 | Barton |

(Continued)

FOREIGN PATENT DOCUMENTS

JP 2005028000 A * 2/2005 ..... A47C 19/122

OTHER PUBLICATIONS

U.S. Appl. No. 15/144,575, filed May 2, 2016.

(Continued)

*Primary Examiner* — Robert G Santos
*Assistant Examiner* — Alison N Labarge
(74) *Attorney, Agent, or Firm* — Morgan, Lewis & Bockius LLP

(57) ABSTRACT

A foldable bed frame includes left and right longitudinal stands. Each of the left and right longitudinal stands includes first and second longitudinal bars pivotally connected to a third longitudinal bar at first and second pivotal points, respectively. Each of the left and right longitudinal stands also includes first, second and third vertical legs fixedly coupled to or integrally formed at the first, second and third longitudinal bars, respectively. The distance between the first vertical leg and the first pivot point is different than the distance between the second vertical leg and the second pivot point such that when folded, one of the first and second vertical legs is disposed in an interior side of the folded left or right longitudinal stand with respect to the other of the first and second vertical legs.

18 Claims, 10 Drawing Sheets

(56) References Cited

U.S. PATENT DOCUMENTS

| | | | | |
|---|---|---|---|---|
| 802,390 | A | 10/1905 | Gusdorf | |
| 1,070,525 | A | 8/1913 | Pieper | |
| 1,196,253 | A | 8/1916 | Lowy | |
| 1,218,868 | A | 3/1917 | Jones | |
| 1,259,825 | A | 3/1918 | Basile | |
| 1,360,983 | A | 11/1920 | Burton | |
| 1,367,173 | A | 2/1921 | Felix | |
| 1,530,726 | A | 3/1925 | Koenigkramer | |
| 1,574,659 | A | 2/1926 | Johnston | |
| 2,513,168 | A | 6/1950 | Gottlieb | |
| 2,651,787 | A | 9/1953 | Piliero | |
| 2,671,229 | A | 3/1954 | Vernier | |
| 2,678,085 | A | 5/1954 | De Minno | |
| 2,701,603 | A | 2/1955 | Coopersmith | |
| 2,782,075 | A | 2/1957 | Fagan | |
| 2,888,688 | A | 6/1959 | Worling | |
| 3,108,291 | A | 10/1963 | Eason | |
| 3,245,363 | A | 4/1966 | Kanitz | |
| 3,295,149 | A | 1/1967 | Hall | |
| 3,967,330 | A | 7/1976 | Zawadowsky | |
| 4,048,683 | A | 9/1977 | Chen | |
| 4,594,743 | A | 6/1986 | Owen | |
| 4,620,336 | A | 11/1986 | Miller | |
| 4,654,905 | A | 4/1987 | Miller | |
| 5,517,744 | A | 5/1996 | Moser | |
| 5,608,930 | A | 3/1997 | Chen | |
| 5,894,614 | A | 4/1999 | Stroud | |
| 6,151,730 | A | 11/2000 | Weston | |
| 6,230,344 | B1 | 5/2001 | Thompson | |
| 6,643,900 | B2 | 11/2003 | Jahrling | |
| 7,376,989 | B2 | 5/2008 | Wickstrom | |
| 7,406,727 | B2 | 8/2008 | Wickstrom | |
| 7,503,086 | B2 | 3/2009 | Wickstrom | |
| 8,312,576 | B1 | 11/2012 | Oh | |
| 8,370,973 | B1 | 2/2013 | Oh | |
| 8,707,478 | B2 * | 4/2014 | Jin | A47C 19/04 5/112 |
| 8,769,740 | B2 | 7/2014 | Oh | |
| 8,898,832 | B2 | 12/2014 | Oh | |
| 8,978,176 | B1 | 3/2015 | Oh | |
| 9,027,181 | B1 | 5/2015 | Yu | |
| 9,226,590 | B1 | 1/2016 | Hull et al. | |
| 9,314,386 | B1 | 4/2016 | Boyd | |
| 9,456,699 | B1 | 10/2016 | Oh | |
| 9,526,347 | B2 | 12/2016 | Boyd | |
| 9,538,850 | B2 | 1/2017 | Oh | |
| 9,907,405 | B2 * | 3/2018 | An | A47C 19/122 |
| 10,034,551 | B2 | 7/2018 | Hull | |
| 10,123,629 | B2 | 11/2018 | Choi | |
| 10,285,506 | B2 | 5/2019 | Choi | |
| 10,321,767 | B2 | 6/2019 | Jin | |
| 2003/0039506 | A1 | 2/2003 | Chen | |
| 2005/0251911 | A1 | 11/2005 | Wickstrom | |
| 2006/0195982 | A1 | 9/2006 | Cloer | |
| 2006/0230532 | A1 | 10/2006 | Wickstrom | |
| 2008/0000024 | A1 | 1/2008 | Peixin | |
| 2009/0133191 | A1 * | 5/2009 | Harrow | A47C 19/005 5/202 |
| 2009/0293193 | A1 | 12/2009 | Neatherry | |
| 2010/0115696 | A1 | 5/2010 | Felix, Jr. et al. | |
| 2010/0235989 | A1 | 9/2010 | Jin | |
| 2010/0299831 | A1 * | 12/2010 | Lee | A47C 19/126 5/202 |
| 2011/0073723 | A1 | 3/2011 | Ashpole | |
| 2011/0099712 | A1 | 5/2011 | Jin | |
| 2012/0042449 | A1 | 2/2012 | Hull | |
| 2012/0222216 | A1 | 9/2012 | Jin | |
| 2012/0246826 | A1 | 10/2012 | Jin | |
| 2013/0067659 | A1 | 3/2013 | Oh | |
| 2013/0067862 | A1 | 3/2013 | Oh | |
| 2013/0276229 | A1 | 10/2013 | Hsieh | |
| 2014/0345044 | A1 | 11/2014 | Murphy | |
| 2015/0143630 | A1 * | 5/2015 | Harrow | A47C 19/122 5/400 |
| 2015/0320225 | A1 | 11/2015 | Boyd | |
| 2016/0143447 | A1 | 5/2016 | Hull | |
| 2016/0206112 | A1 * | 7/2016 | Oh | A47C 19/126 |
| 2016/0262547 | A1 | 9/2016 | Jin | |
| 2016/0281770 | A1 | 9/2016 | Vankoughnett | |
| 2016/0302582 | A1 | 10/2016 | Oh | |
| 2016/0302583 | A1 | 10/2016 | Oh | |
| 2016/0316922 | A1 | 11/2016 | Choi | |
| 2017/0119166 | A1 | 5/2017 | An | |
| 2017/0295943 | A1 * | 10/2017 | Barr | A47C 19/025 |
| 2017/0325592 | A1 | 11/2017 | Suh | |
| 2018/0116412 | A1 | 5/2018 | Jin | |
| 2019/0045938 | A1 | 2/2019 | Skaggs | |

OTHER PUBLICATIONS

U.S. Appl. No. 15/144,471, filed May 2, 2016.
U.S. Appl. No. 15/056,150, filed Nov. Feb. 29, 2016.
U.S. Appl. No. 15/820,754, filed Nov. 22, 2017.
U.S. Appl. No. 15/820,848, filed Nov. 22, 2017.
U.S. Appl. No. 15/423,251, filed Feb. 2, 2017.
U.S. Appl. No. 15/640,810, filed Jul. 3, 2017.
U.S. Appl. No. 15/663,522, filed Jul. 28, 2017.

* cited by examiner

FOLDABLE BED FRAME WITH ASYMMETRICALLY ARRANGED SUPPORTING LEGS

CROSS-REFERENCE TO RELATED APPLICATIONS

The present application claims priority of Chinese Utility Model Application CN 201621212778.X filed Nov. 10, 2016, the disclosure of which is incorporated herein for all purposes by reference.

FIELD OF THE INVENTION

The present invention generally relates to foldable bed frames, and more particularly, relates to foldable bed frames with asymmetrically arranged supporting legs.

BACKGROUND

Foldable bed frames are popular because they are convenient and easy to use. There are various different types of foldable bed frames. FIG. 1 illustrates a foldable bed frame disclosed in Chinese Utility Model Application CN 201620033302.3, the disclosure of which is incorporated herein for all purposes by reference.

The foldable bed frame in FIG. 1 includes left and right longitudinal bars, each made of two bars pivotally connected to each other. It also includes four supporting legs, each pivotally connected (e.g., by bolts and nuts) to an end portion of the left or right longitudinal bar. When unfolded, the supporting legs are disposed obliquely at an angle with respect to the left or right longitudinal bar.

As the supporting legs are pivotally connected to the longitudinal bars, they can be folded onto the longitudinal bars to minimize the folded size of the bed frame. However, to facilitate the pivotal connection of the supporting legs with the left or right longitudinal bar, it requires additional components (e.g., connecting pieces, bolts, nuts) and additional manufacturing processes (e.g., processes to make through holes). It also requires additional installation processes (e.g., processes to couple the legs with the bars via through holes, bolts and nuts). As such, the foldable bed frame disclosed in FIG. 1 is difficult to make and use, and it is not cost effective.

Given the current state of the art, there remains a need for foldable bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides foldable bed frames that are compact, cost effective, and easy to make and use.

In various exemplary embodiments, the present invention provides a foldable bed frame including left and right longitudinal stands. Each of the left and right longitudinal stands includes first, second and third longitudinal bars, and first, second and third vertical legs coupled to the first, second and third longitudinal bars. Each of the first and second longitudinal bars has a proximal end portion and a distal end portion. The third longitudinal bar is pivotally connected to the proximal end portion of the first longitudinal bar at a first pivot point, and pivotally connected to the proximal end portion of the second longitudinal bar at a second pivot point. The first vertical leg is fixedly coupled to or integrally formed at the distal end portion of the first longitudinal bar. The second vertical leg is fixedly coupled to or integrally formed at the distal end portion of the second longitudinal bar. The third vertical leg is fixedly coupled to or integrally formed at the third longitudinal bar. A distance between the first vertical leg and the first pivot point is different than a distance between the second vertical leg and the second pivot point such that when folded, one of the first and second vertical legs is disposed in an interior side of the folded left or right longitudinal stand with respect to the other of the first and second vertical legs.

In an exemplary embodiment, the distance between the first vertical leg and the first pivot point is longer than the distance between the second vertical leg and the second pivot point such that when folded, the second vertical leg is disposed in the interior side of the folded left or right longitudinal stand with respect to the first vertical leg.

In some exemplary embodiments, for each of the left and right longitudinal stands, a distance between the first and second pivot points is equal to or longer than a length of the first vertical leg and a length of the second vertical leg such that the left or right longitudinal stand when folded forms a substantially rectangular shape. In an exemplary embodiment, when the left or right longitudinal stand is folded, the first vertical leg is disposed between the second vertical leg and a distal end of the second longitudinal bar.

In some exemplary embodiments, for each of the left and right longitudinal stands, the third longitudinal bar and the third vertical leg collectively forms a T-shaped support. In an exemplary embodiment, the first and second longitudinal bars are substantially the same.

In some exemplary embodiments, each of the left and right longitudinal stands further includes a connecting piece coupled to the distal end portion of the first longitudinal bar, and movable between a vertical position and a horizontal position. The connecting piece at the vertical position is suitable for connecting a head board with the left or right longitudinal stand.

In some exemplary embodiments, the connecting piece includes a stand connecting portion and a head board connecting portion integrally formed with the stand connecting portion. The head board connecting portion is formed with one or more through holes for connecting with the head board. The stand connecting portion has a substantial U-shape to receive the distal end portion of the first longitudinal bar, an upper end portion of the first vertical leg, or both. Each side of the U-shaped stand connecting portion is formed with a L-shaped slot to movably couple with a pin fixed or integrally formed at the distal end portion of the second longitudinal bar. In an exemplary embodiment, the L-shaped slot of the stand connecting portion of the connecting piece includes a first portion along a longitudinal direction of the connecting piece and a second portion substantially perpendicular to the first portion. When the pin is received at a far end of the first portion of the L-shaped slot, the connecting piece is at the vertical position suitable for connecting the head board.

In some exemplary embodiments, the foldable bed frame further includes one or more lateral bars. Each lateral bar has a left end portion removably coupled to the first, second or third longitudinal bar of the left longitudinal stand and a right end portion removably coupled to the first, second or third longitudinal bar of the right longitudinal stand. In an exemplary embodiment, each lateral bar includes a first lateral bar and a second lateral bar telescopically coupled to each other.

In some exemplary embodiments, each of the left and right end portions of each lateral bar includes an end plate. Corresponding to the end plate, the first, second or third longitudinal bar of the left or right longitudinal stand includes a slot formed at an interior side of the first, second or third longitudinal bar to accommodate the end plate, thereby removably coupling each lateral bar with the left or right longitudinal stand. In an exemplary embodiment, the slot is a gap between the interior side of the first, second or third longitudinal bar and a piece attached to the first, second or third longitudinal bar.

In some exemplary embodiments, the foldable bed frame further includes one or more fourth vertical legs, each coupled to a corresponding lateral bar in the one or more lateral bars.

In various exemplary embodiments, the present invention provides a foldable bed frame including left and right longitudinal stands. Each of the left and right longitudinal stands includes first, second and third longitudinal bars, and first, second and third vertical legs coupled to the first, second and third longitudinal bars. Each of the first and second longitudinal bars has a proximal end portion and a distal end portion. The third longitudinal bar is pivotally connected to the proximal end portion of the first longitudinal bar at a first pivot point, and pivotally connected to the proximal end portion of the second longitudinal bar at a second pivot point. The first vertical leg is fixedly coupled to or integrally formed at the distal end portion of the first longitudinal bar. The second vertical leg is fixedly coupled to or integrally formed at the distal end portion of the second longitudinal bar. The third vertical leg is fixedly coupled to or integrally formed at the third longitudinal bar. The foldable bed frame further includes a connecting piece configured to connect the left or right longitudinal stand with a head board. The connecting piece includes a stand connecting portion and a head board connecting portion integrally formed with the stand connecting portion. The head board connecting portion is formed with one or more through holes for connecting with the head board. The stand connecting portion has a substantial U-shape to receive the distal end portion of the first longitudinal bar, an upper end portion of the first vertical leg, or both. Each side of the U-shaped stand connecting portion is formed with a L-shaped slot to movably couple with a pin fixed or integrally formed at the distal end portion of the second longitudinal bar.

In some exemplary embodiments, the L-shaped slot of the stand connecting portion of the connecting piece includes a first portion along a longitudinal direction of the connecting piece and a second portion substantially perpendicular to the first portion. When the pin is received at a far end of the first portion of the L-shaped slot, the connecting piece is at the vertical position suitable for connecting the head board.

The foldable bed frames of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

DETAILED DESCRIPTION

Figure 1:
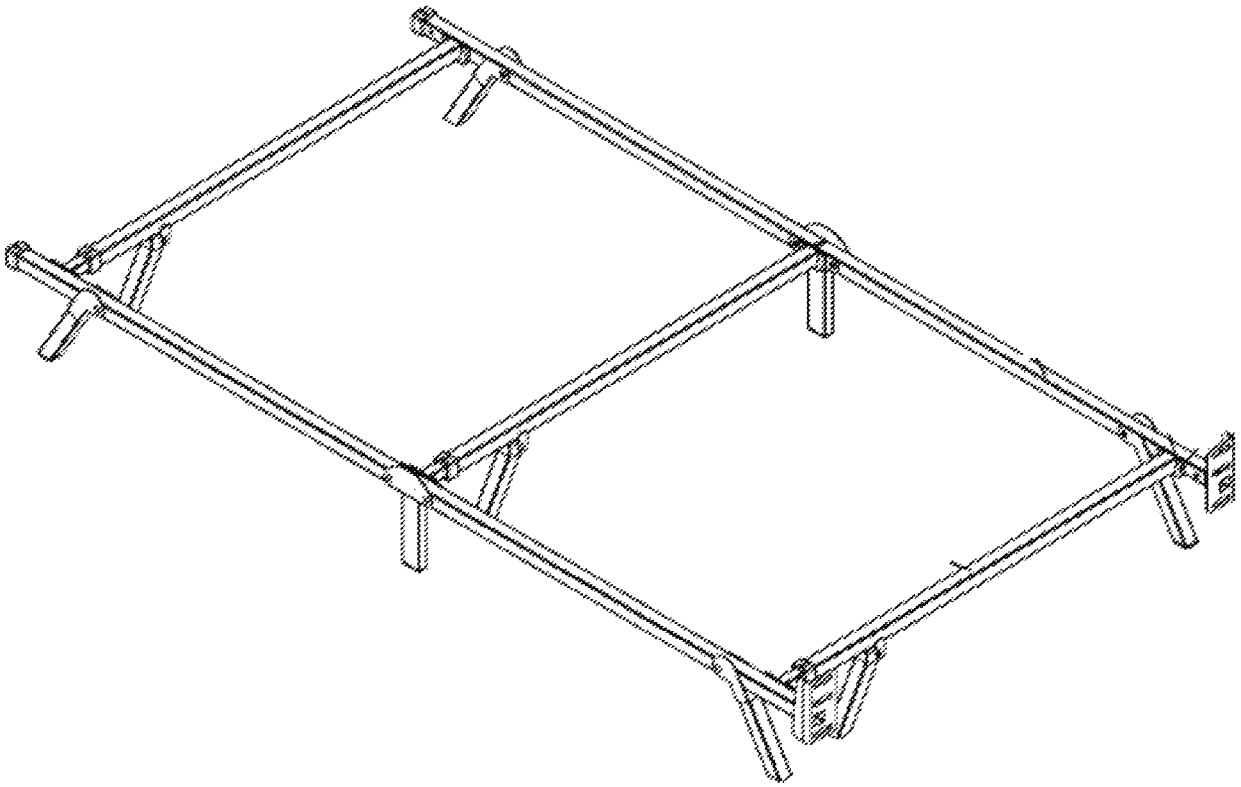
FIG. 1 (Related Art)
FIG. 1 is a schematic view illustrating a bed frame of a related art.

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of foldable bed frames. The foldable frames can be of various sizes including but not limited to twin, full, queen and king sizes, and of various shapes including but not limited to rectangles and squares. Also, the foldable bed frames can be made of various materials including but not limited to plastics, woods and metals such as iron and steel.

Generally, a foldable bed frame of the present invention includes left and right longitudinal stands disposed at left and right sides of the foldable bed frame when the foldable bed frame is unfolded. Each of the left and right longitudinal stands includes longitudinal bars pivotally connected to each other, and supporting legs fixedly coupled to or integrally formed at the longitudinal bars. In various embodiments, a foldable bed frame of the present invention also includes a plurality of lateral stands coupled to the longitudinal bars of the left and right longitudinal stands.

Referring now to FIGS. 2-8, in various exemplary embodiments, exemplary foldable bed frame 100 includes longitudinal stands such as left and right longitudinal stands 10. The left and right longitudinal stands are configured to be disposed at left and right sides of the bed frame, and in many cases, are substantially parallel to each other when the bed frame is unfolded. In some cases, the left and right longitudinal stands are similar to or substantially the same as each other.

In many exemplary embodiments, each of left and right longitudinal stands 10 includes a plurality of longitudinal bars such as first longitudinal bar 21, second longitudinal bar 22, and third longitudinal bar 23. Each of the first and second longitudinal bars has a proximal end portion and a distal end portion. The proximal end portion of the first longitudinal bar is pivotally connected to the third longitudinal bar at first pivot point 24, and the proximal end portion of the second longitudinal bar is pivotally connected to the third longitudinal bar at second pivot point 25. In an exemplary embodiment, first longitudinal bar 21 is substantially the same as second longitudinal bar 22. It should be noted that third longitudinal bar 23 can be configured in any suitable forms including but not limited to a bar, a plate, a rod, a stick, or the like, or any combination thereof, as long as it can pivotally connect the first and second longitudinal bars.

As used herein, the sides at which first and second longitudinal bars are connected to each other are referred to as their proximal sides, and the sides opposite to the proximal sides are referred to as their distal sides. For instance, in FIG. 2, the proximal sides of first and second longitudinal bars are in the middle of the bed frame. The distal sides correspond to head and foot sections of the bed frame. The other two sides are referred to as left and right sides. It should be noted that the term "middle" as used herein does not necessarily mean the center of the bed frame, and the term "side" does not necessarily mean an outmost edge of the bed frame.

Exemplary foldable bed frame 100 also includes a plurality of supporting legs such as first vertical leg 31, second vertical leg 32 and third vertical leg 33. The first vertical leg is fixedly coupled to (e.g., by welding or fastening) or integrally formed at the distal end portion of the first longitudinal bar. The second vertical leg is fixedly coupled to (e.g., by welding or fastening) or integrally formed at the distal end portion of the second longitudinal bar. The third vertical leg is fixedly coupled to or integrally formed at the third longitudinal bar. As used herein, the term "vertical leg" refers to a supporting leg that is perpendicular to or substantially perpendicular to its corresponding longitudinal bar. When the bed frame is unfolded, the vertical leg is upright and supports the longitudinal bar.

In some exemplary embodiments, for each of the left and right longitudinal stands, the third longitudinal bar and the third vertical leg collectively forms a T-shaped support, designated by reference numeral 11 in the figures. In many exemplary embodiments, for each of the left and right longitudinal stands, the first and second vertical legs are arranged asymmetrically with respect to the T-shaped support 11 such that when unfolded, the first and second vertically legs are not aligned with respect to each other.

Figure 6:
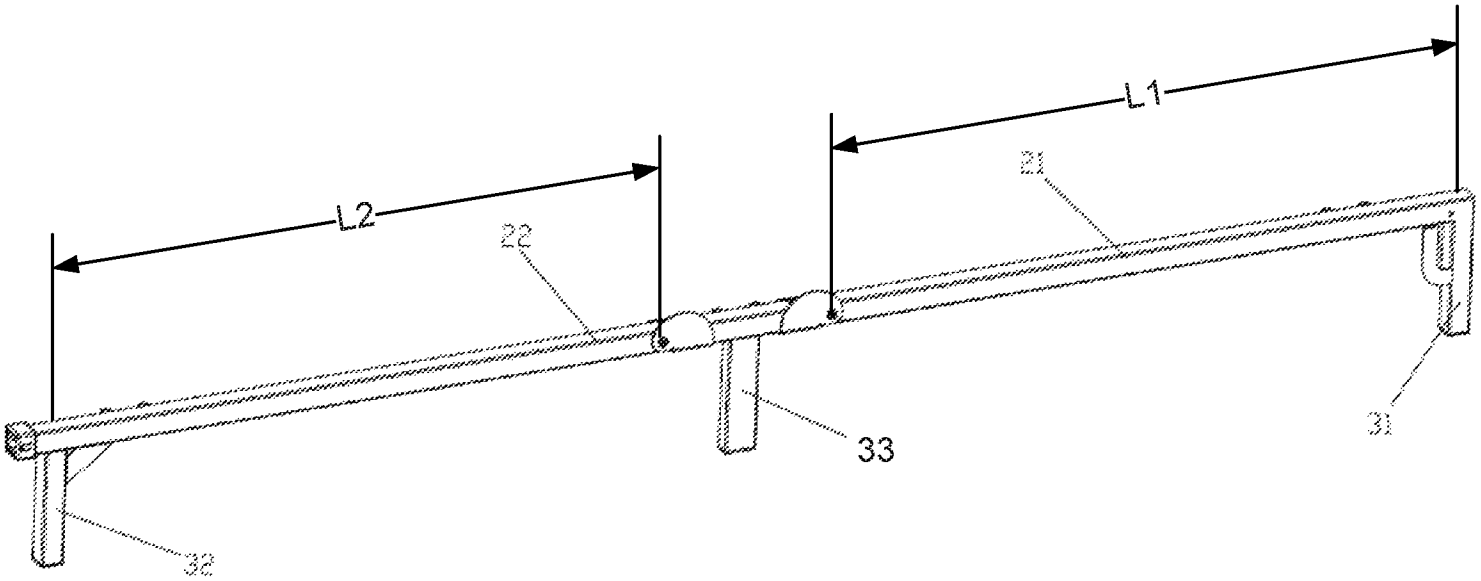
FIG. 6 is a schematic view illustrating an exemplary longitudinal stand of the exemplary foldable bed frame of FIG. 2 in accordance with some exemplary embodiments of the present invention.
Figure 7:
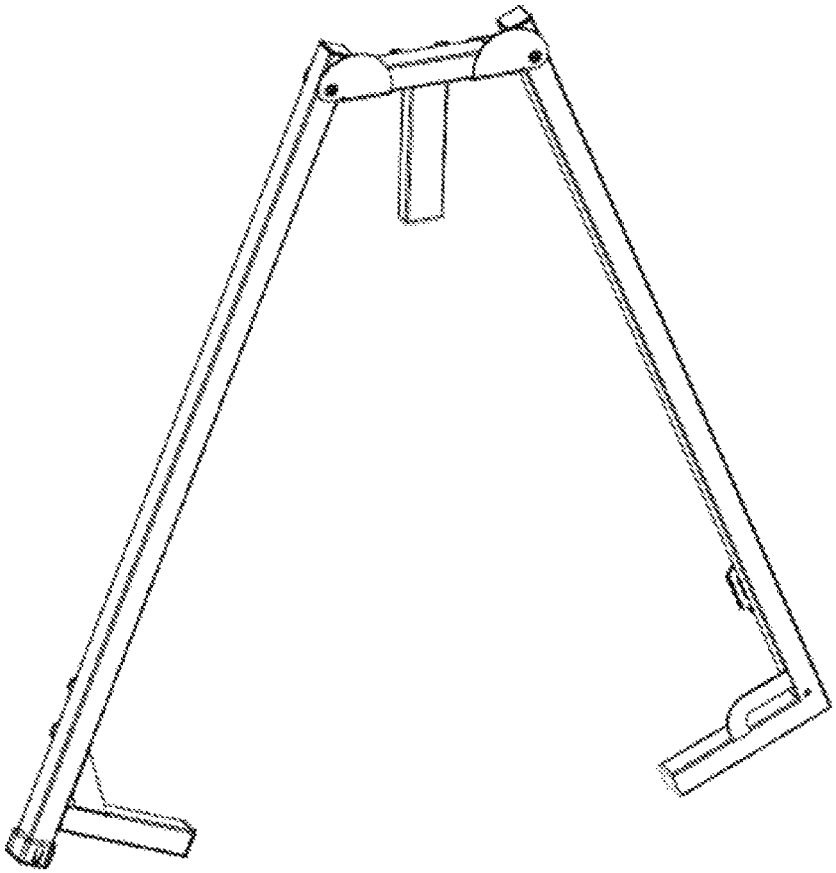
FIG. 7 is a schematic view illustrating the longitudinal stand of FIG. 6 in a partially folded state.
Figure 8:
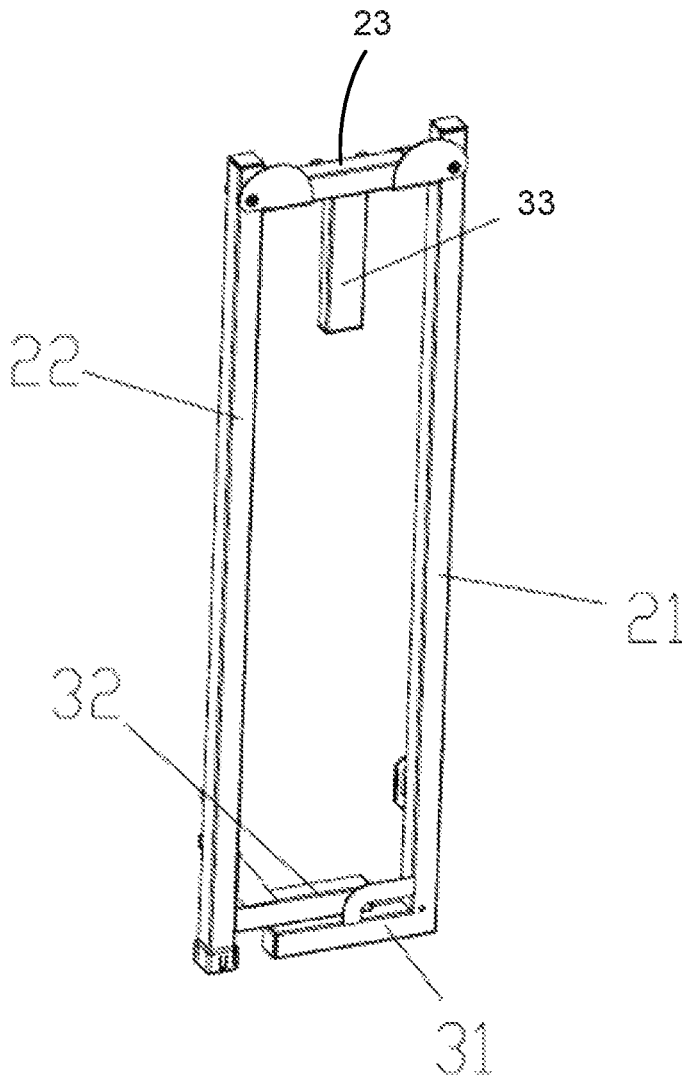
FIG. 8 is a schematic view illustrating the longitudinal stand of FIG. 6 in a folded state.

For instance, referring in particular to FIGS. 6 and 8, in some exemplary embodiments, each of the left and right stands is configured to have the distance between the first vertical leg and the first pivot point (L1) different from the distance between the second vertical leg and the second pivot point (L2). As such, when folded, one of the first and second vertical legs is disposed in an interior side of the folded left or right longitudinal stand with respect to the other of the first and second vertical legs. In some exemplary embodiments, the distance between the first vertical leg and the first pivot point (L1) is longer than the distance between the second vertical leg and the second pivot point (L2). In such embodiments, when the left or right stand is folded, the second vertical leg is disposed in the interior side of the folded left or right longitudinal stand with respect to the first vertical leg. In some embodiments such as those illustrated in FIGS. 6 and 7, the first vertical leg is aligned substantially with the free end of the first longitudinal bar, and the second vertical leg is disposed away from the free end of the second longitudinal bar. When folded, the first vertical leg is aligned substantially with the free end of the second longitudinal bar as illustrated in FIG. 8, with the second vertical leg disposed in an interior side of the folded left or right longitudinal stand.

In some exemplary embodiments, each of the left and right stands is configured to have the distance between the first and second pivot points equal to or longer than a length of the first vertical leg and a length of the second vertical leg. In such embodiments, when folded, each of the left and right longitudinal stands forms a substantially rectangular shape as illustrated in FIG. 8. This reduces or minimizes the folded sizes of the left and right longitudinal stands, and thus reduces or minimizes the folded size of the bed frame (i.e., the size of the bed frame when folded).

In an exemplary embodiment, the second vertical leg is fixedly coupled to or integrally formed at the second longitudinal bar adjacent to the distal end of the second longitudinal bar. In such an embodiment, when folded, the first vertical leg is disposed between the second vertical leg and the distal end of the second longitudinal bar.

Figure 10:
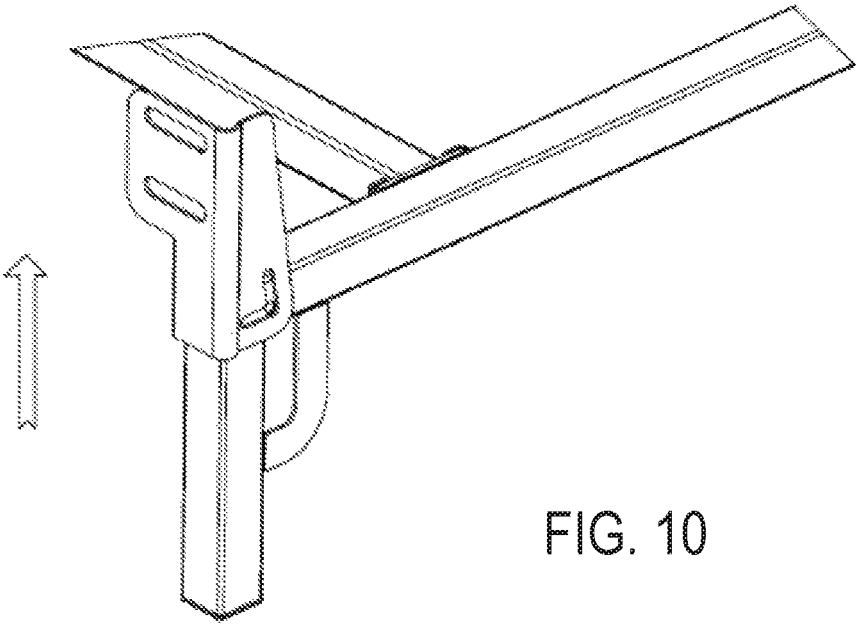
FIG. 10, FIG. 11 and FIG. 12 are schematic views illustrating a connecting piece of FIG. 9 in accordance with some exemplary embodiments of the present invention.
Figure 11:
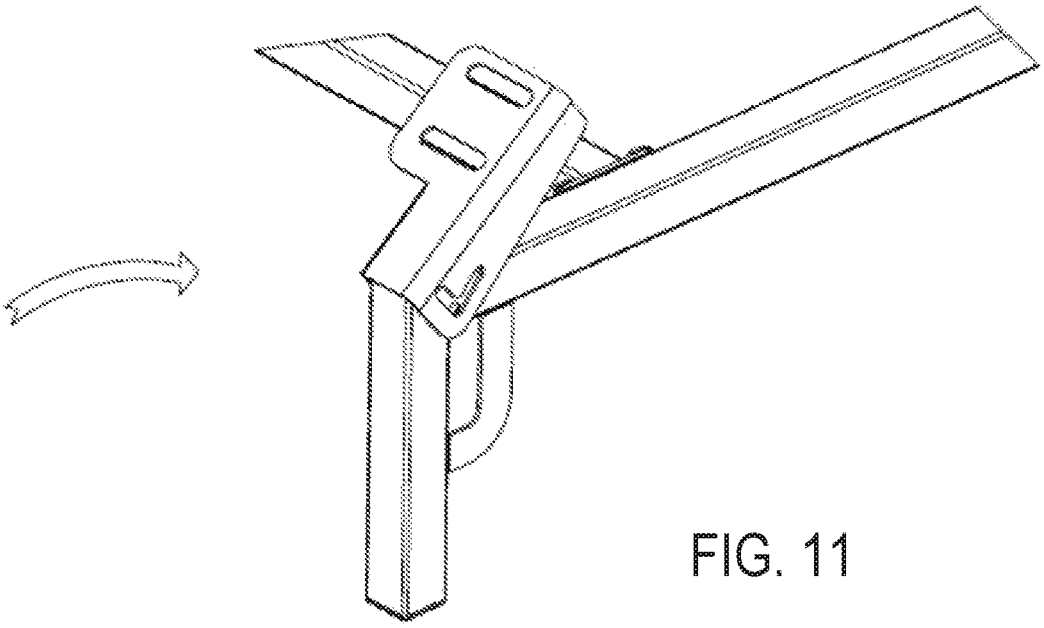
Figure 12:
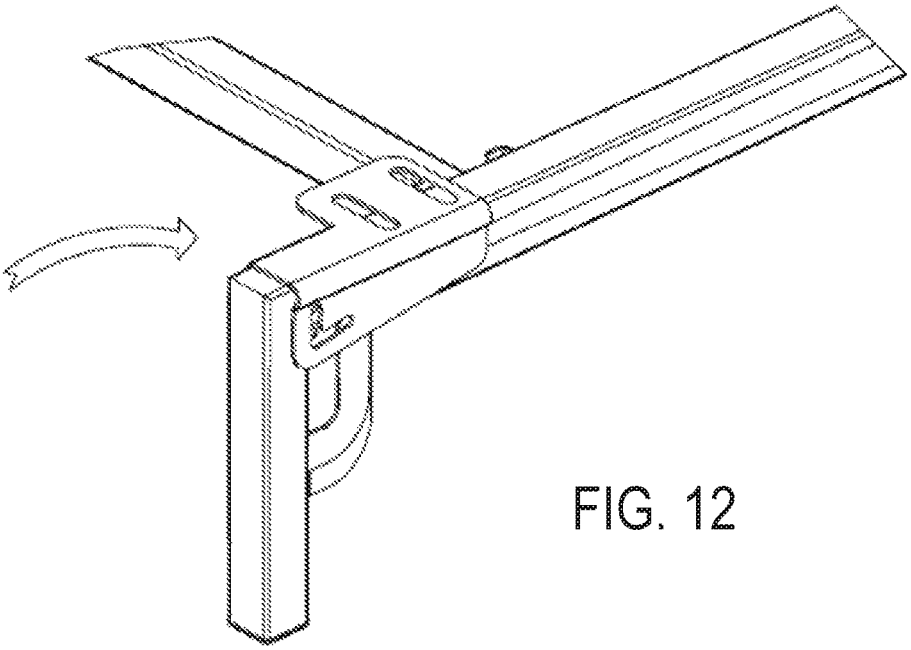

Referring to FIGS. 2 and 9-12, in many exemplary embodiments, each of the left and right longitudinal stands further includes a connecting piece such as connecting piece 40 movably coupled to the distal end portion of the first longitudinal bar between a vertical position (e.g., the position illustrated in FIG. 9) and a horizontal position (e.g., the position illustrated in FIG. 12). In some exemplary embodiments, the connecting piece includes stand connecting portion 42 and head board connecting portion 43 integrally formed with the stand connecting portion. The head board connecting portion is formed with one or more through holes such as through hole 44. When the connecting piece is at the vertical position, the head board connecting portion is suitable for connecting a head board, for instance, by bolting or the like via the one or more through holes of the head board connecting portion.

In some exemplary embodiments, stand connecting portion 42 has a substantial U-shape with an opening and two sides to receive the distal end portion of the first longitudinal bar, the upper end portion of the first vertical leg, or both of the distal end portion of the first longitudinal bar and the upper end portion of the first vertical leg. Each side of the U-shaped stand connecting portion is formed with L-shaped slot 41 to movably couple with pin 26. Pin 26 is fixed or integrally formed at the distal end portion of the second longitudinal bar.

Figure 9:
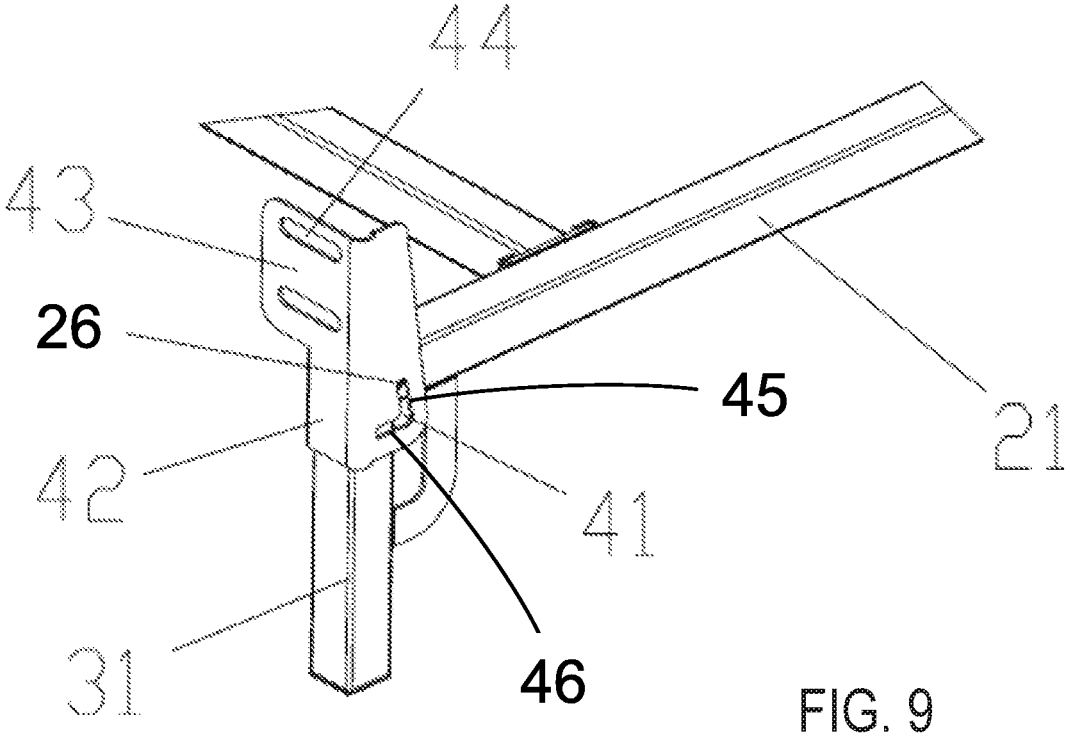
FIG. 9 is a partially enlarged view taken along circle B of FIG. 2.

In an exemplary embodiment, the L-shaped slot of the stand connecting portion of the connecting piece includes first portion 45 along a longitudinal direction of the connecting piece and second portion 46 substantially perpendicular to first portion 45. The L-shaped slot and the pin are configured such that when the pin is received at a far end of the first portion of the L-shaped slot, the connecting piece is at the vertical position as illustrated in FIG. 9. At this vertical position, the connecting piece can be used to connect a head board with the left or right longitudinal stand.

When connection of a head board is not desired, the connecting piece can be pushed upward as illustrated in FIG. 10, while the pin moves relatively downward along the first portion of the L-shaped slot. When the pin reaches the junction of the first and second portions of the L-shaped slot, the connecting piece can be turned toward the first longitudinal bar as illustrated in FIG. 11, until the second portion of the L-shaped slot is substantially vertical as illustrated in FIG. 12. At this position, in an exemplary embodiment, the head board connecting portion is disposed above and in surface contact with the first longitudinal bar (e.g., the connecting piece is at the horizontal position). In some exemplary embodiments, the connecting piece can be pushed downward, while the pin moves relatively upward along the second portion of the L-shaped slot, until the head board connecting portion is in surface contact with the first longitudinal bar.

Figure 2:
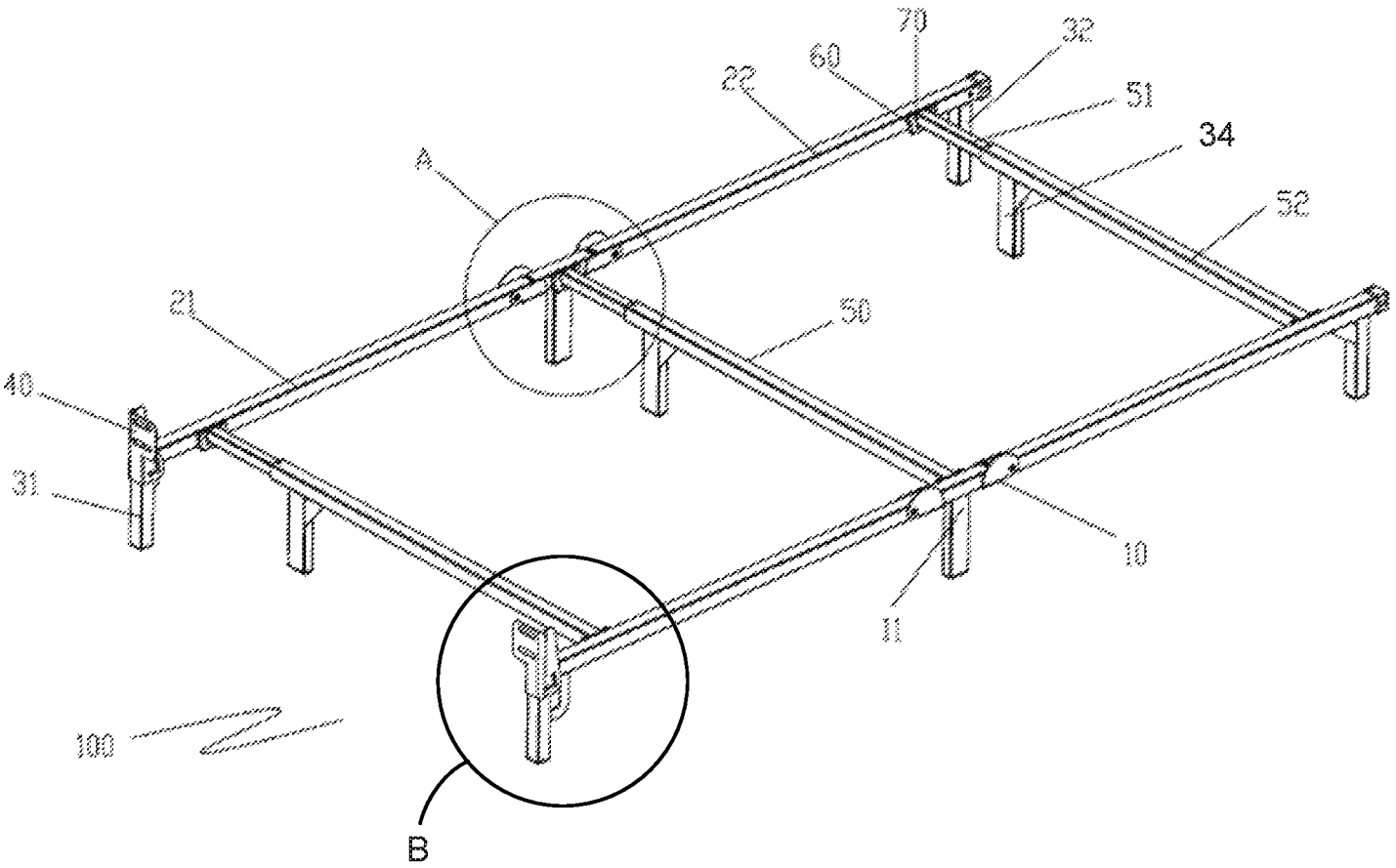
FIG. 2 is a schematic perspective view illustrating an exemplary foldable bed frame in accordance with some exemplary embodiments of the present invention.
Figure 3:
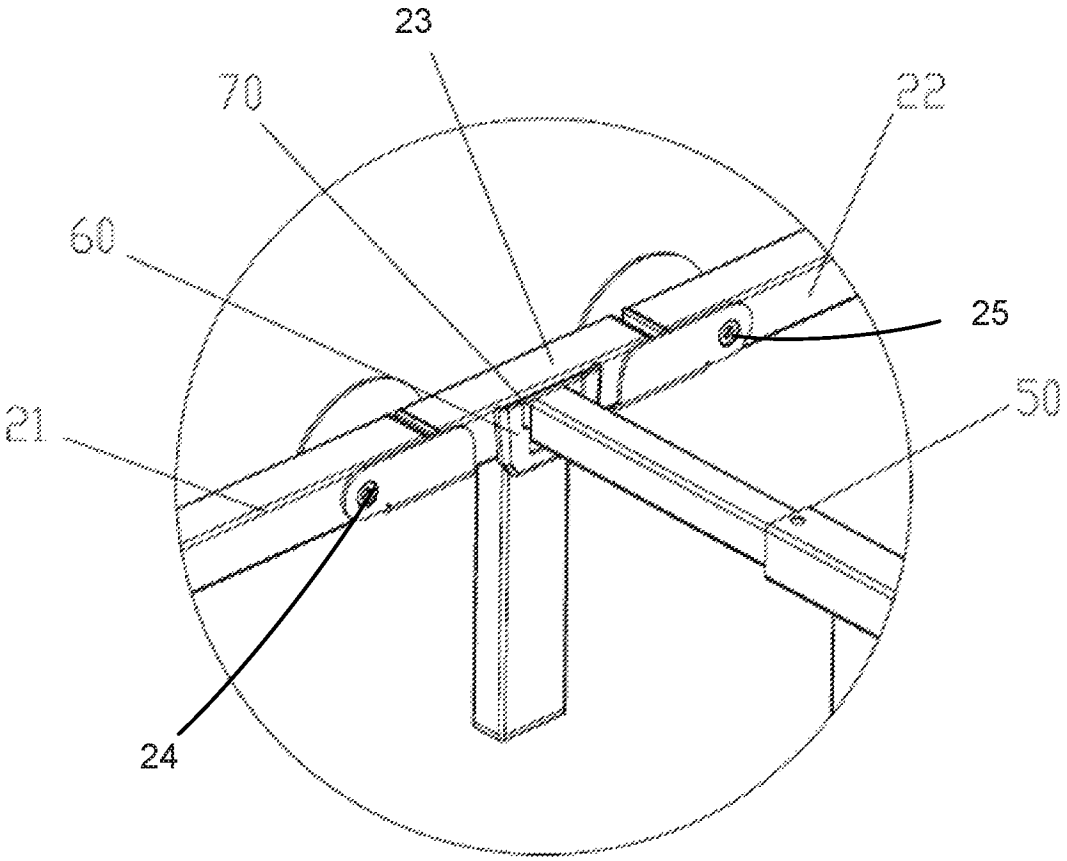
FIG. 3 is a partially enlarged view taken along circle A of FIG. 2.
Figure 4:
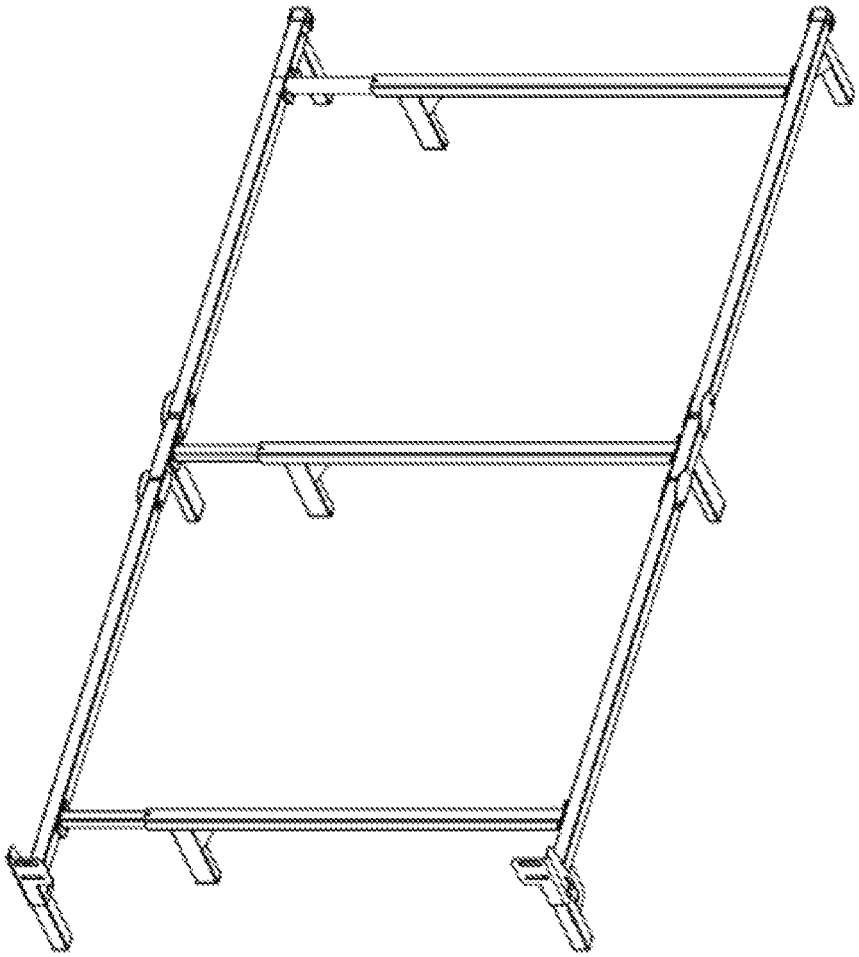
FIG. 4 is a schematic perspective view illustrating the exemplary foldable bed frame of FIG. 2 in a first unfolded state.
Figure 5:
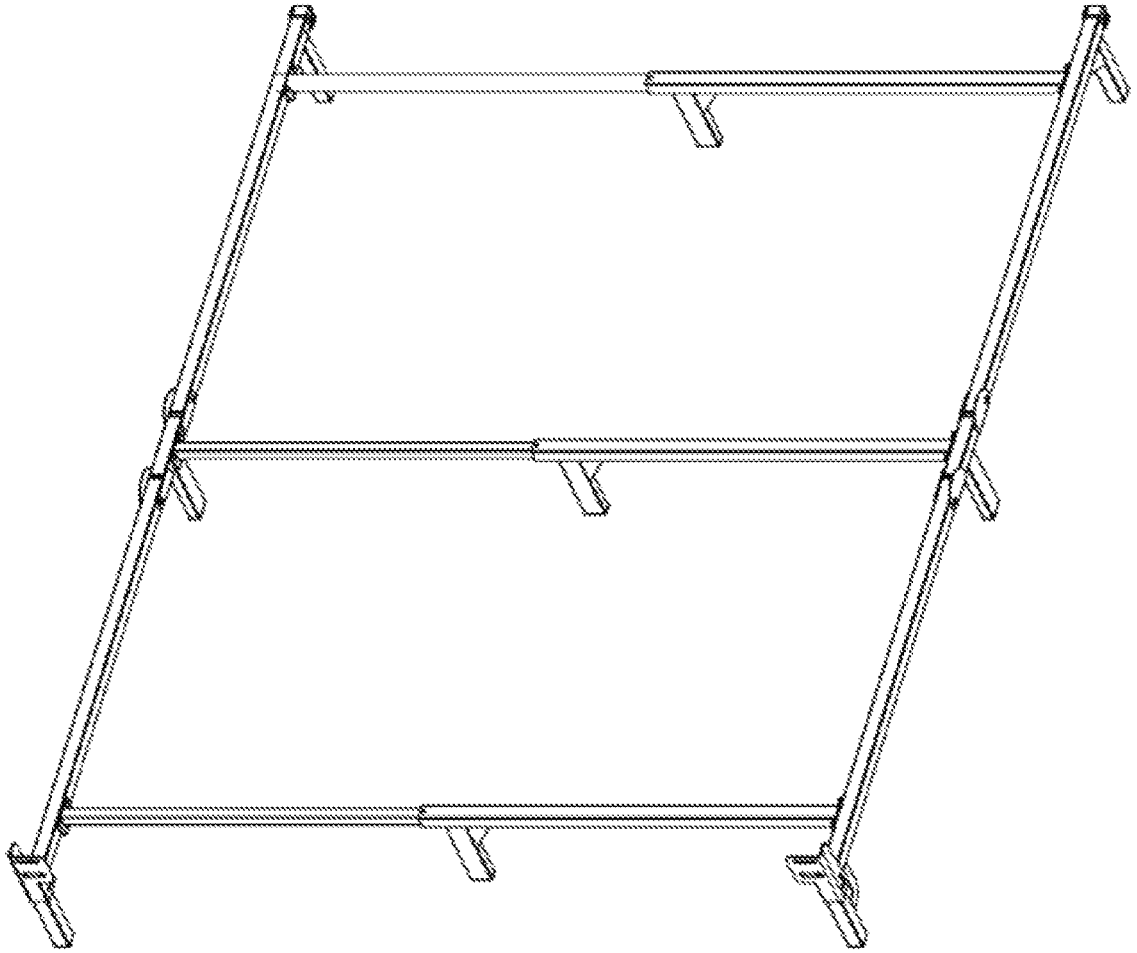
FIG. 5 is a schematic perspective view illustrating the exemplary foldable bed frame of FIG. 2 in a second unfolded state.

Foldable bed frame 100 can include other additional, optional, or alternative components. For instance, in some exemplary embodiments, foldable bed frame 100 further includes one or more lateral bars 50. Each lateral bar has a left end portion removably coupled to the first, second or third longitudinal bar of the left longitudinal stand and a right end portion removably coupled t to the first, second or third longitudinal bar of the right longitudinal stand. In an exemplary embodiment, each lateral bar includes a first lateral bar such as first lateral bar 51 and a second lateral bar such as lateral bar 52 telescopically coupled to each other as illustrated in FIG. 2. In an exemplary embodiment, foldable bed frame 100 includes three lateral bars disposed respectively at a head portion, a middle portion and a foot portion of the bed frame.

In an exemplary embodiment, each of the left and right end portions of each lateral bar includes an end plate such as end plate 70. Corresponding to the end plate, the first, second or third longitudinal bar of the left or right longitudinal stand includes a slot formed at an interior side of the first, second or third longitudinal bar to accommodate the end plate, thereby removably coupling each lateral bar with the left or right longitudinal stand. In an exemplary embodiment, the slot is a gap between the interior side of the first, second or third longitudinal bar and a piece such as piece 60 attached to the first, second or third longitudinal bar.

In some exemplary embodiments, foldable bed frame 100 further includes one or more fourth vertical legs such as fourth leg 34 illustrated in FIG. 2. Each fourth leg is coupled to a corresponding lateral bar in the one or more lateral bars. In an exemplary embodiment, the lateral bar and the fourth leg collectively form a lateral stand.

The foldable bed frames of the present invention have several advantages. For instance, the foldable bed frames of the present invention include vertical legs fixedly coupled to (e.g., by welding) or integrally formed with longitudinal bars. As such, it enhances the stability of the bed frames, eliminates a number of components used in conventional foldable bed frames to pivotally connect legs with the longitudinal bars, and effectively reduces the manufacturing cost.

Moreover, in various exemplary embodiments, the foldable bed frames include asymmetrically arranged supporting legs, e.g., a distance between the first vertical leg and the first pivot point is different from a distance between the second vertical leg and the second pivot point. When such a bed frame is folded, the first and second vertical legs are not aligned in a line, but rather disposed side by side with one vertical leg in an interior side of the folded longitudinal stand. As such, the size of the bed frame when fold is reduced.

Further, in many exemplary embodiments, the foldable bed frames of the present invention include connecting pieces movably (e.g., translation and rotation) coupled with longitudinal bars. When desired, the connecting pieces can be positioned for use to connect a head board. When connection of a head board is not desired, the connecting pieces can be put down to rest on the longitudinal bars.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "left" and "right", "upward" and "downward" etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first vertical leg could be termed a second vertical leg, and, similarly, a second vertical leg could be termed a first vertical leg, without changing the meaning of the description, so long as all occurrences of the "first vertical leg" are renamed consistently and all occurrences of the "second vertical leg" are renamed consistently.

What is claimed is:

1. A foldable bed frame comprising:

left and right longitudinal stands, each respective longitudinal stand in the left and right longitudinal stands comprising:

a first longitudinal bar having a proximal end portion and a distal end portion thereof;

a second longitudinal bar having a proximal end portion and a distal end portion thereof;

a third longitudinal bar pivotally connected to the proximal end portion of the first longitudinal bar at a first pivot point, and pivotally connected to the proximal end portion of the second longitudinal bar at a second pivot point;

a first vertical leg fixedly coupled to or integrally formed at the distal end portion of the first longitudinal bar;

a second vertical leg fixedly coupled to or integrally formed at the distal end portion of the second longitudinal bar; and a third vertical leg fixedly coupled to or integrally formed at the third longitudinal bar, wherein the first vertical leg is aligned substantially with a free end of the first longitudinal bar, and the second vertical leg is disposed away from a free end of the second longitudinal bar such that when folded, the first vertical leg is aligned substantially with the free end of the second longitudinal bar and substantially perpendicular to the second longitudinal bar, thereby defining an interior along with the first, second and third longitudinal bars of the respective longitudinal stand, and the second vertical leg is disposed in the interior defined by the first vertical leg along with the first, second and third longitudinal bars of the respective longitudinal stand.

2. The foldable bed frame of claim 1, wherein for each of the left and right longitudinal stands, a distance between the first and second pivot points is equal to or longer than a length of the first vertical leg and a length of the second vertical leg such that the left or right longitudinal stand when folded forms a substantially rectangular shape.

3. The foldable bed frame of claim 1, wherein for each of the left and right longitudinal stands, the third longitudinal bar and the third vertical leg collectively forms a T-shaped support.

4. The foldable bed frame of claim 1, wherein the first and second longitudinal bars are substantially the same.

5. The foldable bed frame of claim 1, wherein each of the left and right longitudinal stands further comprises:

a connecting piece coupled to the distal end portion of the first longitudinal bar, and movable between a vertical position and a horizontal position, wherein the connecting piece at the vertical position is suitable for connecting a head board with the left or right longitudinal stand.

6. The foldable bed frame of claim 5, wherein the connecting piece comprises a stand connecting portion and a head board connecting portion integrally formed with the stand connecting portion, wherein the stand connecting portion has a substantial U-shape to receive the distal end portion of the first longitudinal bar, an upper end portion of the first vertical leg, or both, wherein each side of the U-shaped stand connecting portion is formed with a L-shaped slot to movably couple with a pin fixed or integrally formed at the distal end portion of the second longitudinal bar; and the head board connecting portion is formed with one or more through holes for connecting with the head board.

7. The foldable bed frame of claim 6, wherein:

the L-shaped slot of the stand connecting portion of the connecting piece comprises a first portion along a longitudinal direction of the connecting piece and a second portion substantially perpendicular to the first portion, wherein when the pin is received at a far end of the first portion of the L-shaped slot, the connecting piece is at the vertical position suitable for connecting the head board.

8. The foldable bed frame of claim 1, further comprising:

one or more lateral bars, each having a left end portion removably coupled to the first, second or third longitudinal bar of the left longitudinal stand and a right end portion removably coupled t to the first, second or third longitudinal bar of the right longitudinal stand.

9. The foldable bed frame of claim 8, wherein:

each of the left and right end portions of each lateral bar comprises an end plate; and corresponding to the end plate, the first, second or third longitudinal bar of the left or right longitudinal stand comprises a slot formed at an interior side of the first, second or third longitudinal bar to accommodate the end plate, thereby removably coupling each lateral bar with the left or right longitudinal stand.

10. The foldable bed frame of claim 9, wherein the slot is a gap between the interior side of the first, second or third longitudinal bar and a piece attached to the first, second or third longitudinal bar.

11. The foldable bed frame of claim 8, wherein each lateral bar comprises a first lateral bar and a second lateral bar telescopically coupled to each other.

12. The foldable bed frame of claim 8, further comprising one or more fourth vertical legs, each coupled to a corresponding lateral bar in the one or more lateral bars.

13. The foldable bed frame of claim 1, further comprising:

a connecting piece configured to connect the left or right longitudinal stand with a head board, wherein:

the connecting piece comprises a stand connecting portion and a head board connecting portion integrally formed with the stand connecting portion;

the stand connecting portion has a substantial U-shape to receive and abut both the distal end portion of the first longitudinal bar and an upper end portion of the first vertical leg when at a vertical position;

each side of the U-shaped stand connecting portion is formed with a L-shaped slot to movably couple with a pin fixed or integrally formed at the distal end portion of the second longitudinal bar; and the head board connecting portion is formed with one or more through holes for connecting with the head board.

14. The foldable bed frame of claim 13, wherein:

the L-shaped slot of the stand connecting portion of the connecting piece comprises a first portion along a longitudinal direction of the connecting piece and a second portion substantially perpendicular to the first portion, wherein when the pin is received at a far end of the first portion of the L-shaped slot, the connecting piece is at the vertical position suitable for connecting the head board.

15. The foldable bed frame of claim 13, wherein the third longitudinal bar and the third vertical leg collectively forms a T-shaped support.

16. The foldable bed frame of claim 13, further comprising:

one or more lateral bars, each having a left end portion removably coupled to the first, second or third longitudinal bar of the left longitudinal stand and a right end portion removably coupled t to the first, second or third longitudinal bar of the right longitudinal stand.

17. The foldable bed frame of claim 16, wherein each lateral bar comprises a first lateral bar and a second lateral bar telescopically coupled to each other.

18. The foldable bed frame of claim 16, further comprising one or more fourth vertical legs, each coupled to a corresponding lateral bar in the one or more lateral bars.

* * * * *